US005390524A

United States Patent [19]

Higgs

[11] Patent Number: 5,390,524

[45] Date of Patent: Feb. 21, 1995

[54] RIVETING APPARATUS

[75] Inventor: John E. Higgs, Cuffley, England

[73] Assignee: Avdel Systems Limited, Hertfordshire, England

[21] Appl. No.: 59,756

[22] Filed: May 12, 1993

[30] Foreign Application Priority Data

May 15, 1992 [GB] United Kingdom ..... 9210475

[51] Int. Cl.[6] ..... B21D 9/05; B21J 15/06

[52] U.S. Cl. ..... 72/391.6; 29/243.523; 29/243.53

[58] Field of Search ..... 72/391.6, 391.4; 29/243.53, 243.521, 243.523, 243.524, 243.525

[56] References Cited

U.S. PATENT DOCUMENTS

| | | | |
|---|---|---|---|
| 2,004,624 | 6/1935 | Antelme | 72/391.6 |
| 2,340,066 | 1/1944 | Lee | 72/391.6 |
| 2,401,724 | 6/1946 | Dowdle | 72/391.6 |
| 3,557,597 | 1/1971 | Heslop et al. | 29/243.523 X |
| 4,888,974 | 12/1989 | Mandell | 29/243.523 |

FOREIGN PATENT DOCUMENTS

| | | | |
|---|---|---|---|
| 578104 | 6/1946 | United Kingdom | 72/391.6 |

*Primary Examiner*—Rinaldi I. Rada
*Attorney, Agent, or Firm*—Oblon, Spivak, McClelland, Maier & Neustadt

[57] ABSTRACT

A riveting tool of the kind having an elongate, headed, mandrel on which a plurality of tubular rivets are supported as a column, and which can be gripped and reciprocated relative to an abutment by reciprocable gripping jaws so as to draw the head of the mandrel through each rivet supported in turn by the abutment, and having a mechanism for feeding the column of rivets towards the head of the mandrel, has both the rivet feeding mechanism and the gripping of the mandrel by the jaws operated pneumatically, each respectively being under the control of a manually operable valve. In order to avoid the possibility of the feeding mechanism being actuated at a time when the mandrel is not gripped by the jaws, the valves are interengaged with a detent arranged to prevent opening of the valve which controls the rivet feeding mechanism when the valve which controls the jaws is closed.

14 Claims, 2 Drawing Sheets

RIVETING APPARATUS

BACKGROUND OF THE INVENTION

1. Field of the Invention

This invention relates to riveting apparatus of the kind whereby a plurality of tubular blind rivets may be set in succession by drawing through the bore of each one of the rivets in turn an enlarged head of a riveting mandrel while the rivet is supported by an abutment.

2. Discussion of the Background

More particularly, the invention relates to riveting apparatus of the kind in which an elongated mandrel, having an enlarged head at one end and loaded with a plurality of the tubular rivets forming a column of rivets on the mandrel, is gripped by gripping means at or near the end remote from the head, and reciprocated relative to an abutment by relative reciprocation between the gripping means and the abutment, and in which a pneumatically operated rivet-feeding means applies a thrust to the column of rivets to urge the column forwardly along the mandrel towards the head of the mandrel so that the rivet nearest the head of the mandrel becomes disposed forwardly of the abutment, and can then be set by moving the mandrel rearwardly relative to the abutment so as to draw the head of the mandrel through the bore of the rivet while the rivet is supported by the abutment. Such apparatus is hereinafter referred to as the "riveting apparatus of the kind defined".

The abutment is usually provided by a nosepiece comprising jaws between which the mandrel extends, and which are separable to allow rivets which are fed forwardly along the mandrel to pass between them, the jaws being spring urged to close together behind a fed rivet which has passed forwardly of the jaws, and to resist rearward movement of the fed rivet.

Relative reciprocation between the abutment and the mandrel gripping means can be produced by either pneumatically or hydraulically powered means.

There is a danger with such tools that, if pneumatic power is applied to the rivet-feeding means at a time when the mandrel is not gripped securely by the gripping means, then the mandrel and its load of rivets can be expelled, forcefully, from the tool by the operation of the rivet feeding means.

In some such tools, the gripping means is in the form of a chuck having jaws which have to be closed on the mandrel by manual rotation of a jaw-adjusting device. Safe operation of such tools relies on the operator clamping the loaded mandrel in the tool in this manner before causing the rivet-feeding means to operate.

Such a tool is described in GB 1183049, corresponding to U.S. Pat. No. 3,557,597, which also describes a modification of the tool in which the gripping means is pneumatically operated. Thus, in the modification, both the rivet-feeding means and the mandrel gripping means are pneumatically operated by a common supply of air or other suitable gas under the primary control of a single on/off valve provided in an air-supply pipeline at a position more or less remote from the tool.

In order to ensure that the rivet feeding means could not operate if the mandrel were not gripped by the gripping means, it was necessary to provide the tool with means whereby the operation of the rivet feeding means would be disabled if the mandrel was not gripped by the gripping means. In the embodiment described in U.S. Pat. No. 3,557,597, the disabling means takes the form of a valve (57a, 75, 76) which is opened automatically so as to vent to atmosphere the air supply for the rivet-feeding means, by an extended movement of the gripping means, when the gripping means moves to grip a mandrel but fails to engage a mandrel.

SUMMARY OF THE INVENTION

The need for such an automatically operable means for disabling the rivet feed means adds considerably to the complexity of the tool.

We have found that it is simpler to provide manually operable means for controlling the operation of both the gripping means and the rivet-feeding means provided that the manually operable means is adapted to prevent actuation of the rivet-feeding means when the gripping means is not actuated.

According to the invention there is provided riveting apparatus of the kind defined in which the mandrel-gripping means is pneumatically operated, the apparatus including manually operable valve means for controlling the operation of the mandrel-gripping means, manually operable valve means for controlling the operation of the rivet feeding means, and means for interlocking both of said valve means so that the rivet feeding means may be actuated to feed a rivet only when the mandrel gripping means is also actuated to grip the mandrel.

BRIEF DESCRIPTION OF THE DRAWINGS

An embodiment of the invention will now be described, by way of example, with reference to the accompanying diagrammatic drawings, in which.

DESCRIPTION OF THE PREFERRED EMBODIMENT

Figure 1:
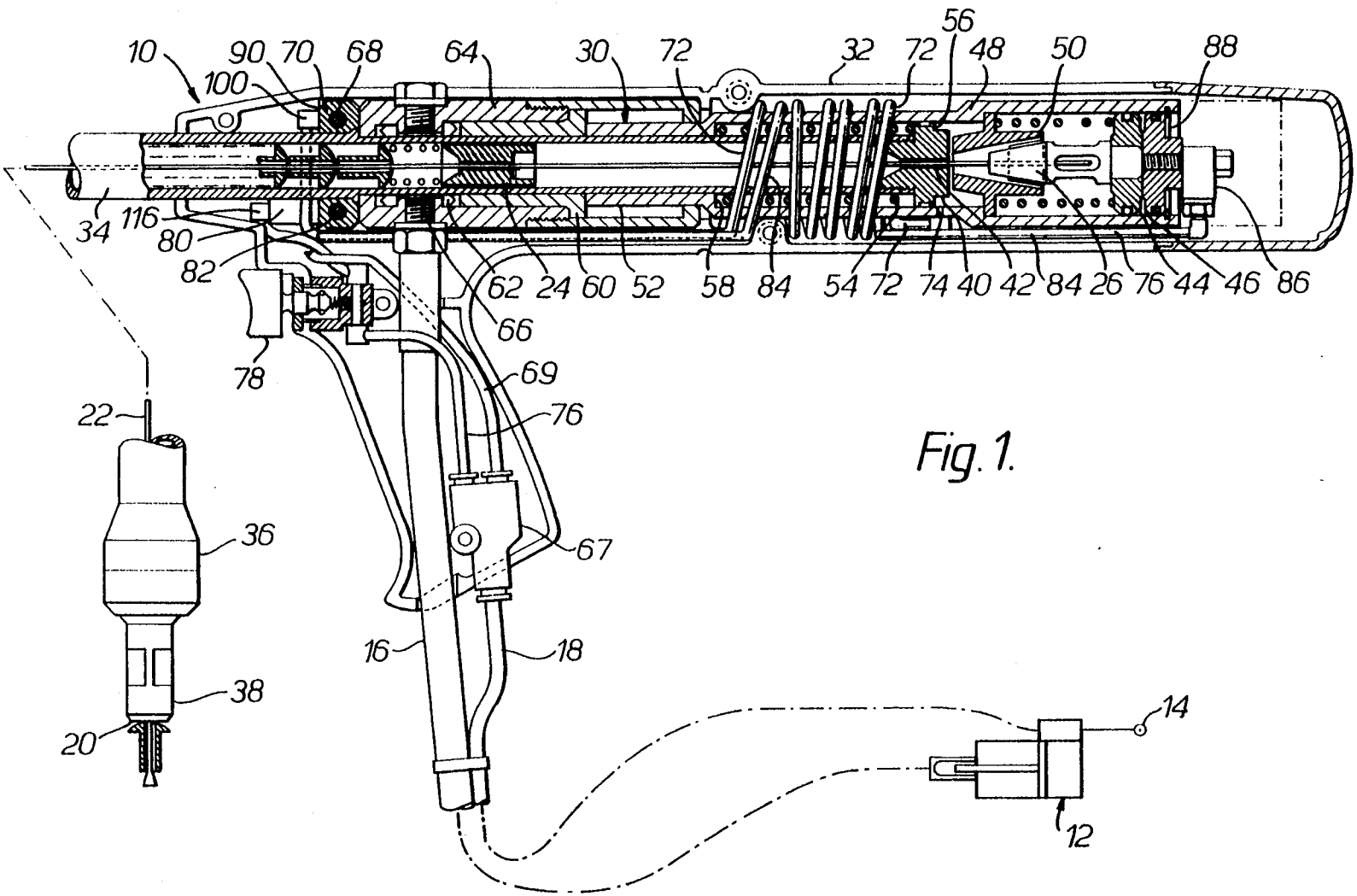
FIG. 1 is a partly schematic view, showing fragmentarily, in longitudinal sectional elevation, part of a hydropneumatic riveting apparatus embodying the invention.

Referring first to FIG. 1 of the drawings, the riveting apparatus of this embodiment comprises a repetition riveting tool 10, intended to be hand-held by an operator, and powered principally by hydraulic pressure, and a hydropneumatic intensifier 12 which can be situated conveniently at a position remote from the tool 10, for example, on the ground or floor.

The intensifier 12 is adapted to be connected to a source 14 of air under pressure, and the tool 10 is connected to the intensifier 12 by a hydraulic line 16, and a dual air line 18.

The dual air line 18 serves both to deliver air under pressure to the tool 10, and to allow the operator to signal to the intensifier 12 when hydraulic power is required, as will be explained subsequently in greater detail.

In this embodiment, hydraulic power is used to perform the main work of the tool, which is the setting of the rivets by drawing the head of a mandrel through their bores so as to expand the rivets. However this work could, alternatively, be performed by pneumatic power if the tool were suitably constructed. In this embodiment hydraulic power is used because it enables the tool to be made more compact and light weight in construction.

So far as concerns the principles of the present invention, we believe it is immaterial whether the tool is operated by pneumatic or hydraulic power.

The tool 10 comprises essentially an abutment 20 for supporting a rivet in a rivet setting operation, a headed elongate mandrel 22 which is reciprocable lengthwise of its axis relative to the abutment 20 and which can be loaded with a plurality of tubular blind rivets, a pneumatically driven cursor 24 for feeding rivets along the mandrel, pneumatically operated mandrel-gripping means comprising jaws 26 for releasably gripping the end of the mandrel remote from the head, and hydraulically operated actuator means indicated generally at 30 for reciprocating the mandrel relative to the abutment so as to draw the head of the mandrel through a rivet supported by the abutment.

The mandrel gripping means and the actuator means form the main body of the tool and are housed in a housing 32.

An elongate tubular barrel 34 forming part of the actuator constitutes a main member around which the rest of the tool is built. The barrel projects forwardly from the housing 32. A conventional riveting nose assembly 36 comprising a pair of separable nose jaws 38 which cooperate to form the abutment 20, is screwed to the forward end of the barrel 34.

The rear end of the barrel 34 is substantially closed by an annular plug 40 which defines a narrow passageway 42 coaxially with the barrel.

The rivet feeding cursor 24 is slideable within the bore of the barrel between the plug 40 and the nose assembly 36.

The mandrel 22 is disposed with its head forward of the nose jaws, and extends rearwardly between the nose jaws and axially through the barrel 34, passing as a sliding fit through the cursor 24 and the passageway of the plug 40 so that a rear end portion of the mandrel projects rearwardly of the plug and extends between the gripping jaws 26. The gripping jaws are attached to a pneumatic jaw closing piston 44 which is slidable in a pneumatic jaw-closing cylinder 46 formed at the rear end of an elongate tubular ram 48. Admission of pressurized air into the cylinder 46 to the rear of the piston 44 urges the gripping jaws forwardly into a tapered bore of a jaw closer 50, whereby the jaws are forced to close together and grip the end of a mandrel 22 disposed between them.

The tubular ram 48 forms part of the actuator means, and has a forward end portion 52 which is a sliding fit on the external surface of the barrel 34. Normally, the ram 48 is urged forwardly by a helical return spring 54 which abuts a peripheral flange 56 of the plug 40 and a shoulder 58 of the ram. The ram 48 can be moved rearwardly, relative to the barrel 34, by movement of an annular piston 60 in an annular hydraulic chamber 62 formed between the barrel 34 and a peripheral annular cylinder member 64. Hydraulic fluid, delivered under pressure through the line 16 from the intensifier, enters the chamber 62 through an annular port 66, and forces the piston 60 and the ram 48 rearwardly against the urging of the spring 54, thereby moving the mandrel gripping means rearwardly and so pulling rearwardly the mandrel gripped by the jaws 26.

Admission of pressurized air, through the passageway 42, into the bore of the barrel, and rearwardly of the cursor 24, causes the cursor to be urged forwardly, and this to urge forwardly a column of rivets disposed on the mandrel.

Thus, each of the rivets in turn can be urged past the nose jaws to a position at which it can then be set by rearward movement of the mandrel relative to the nose jaws.

In use of the tool, with the mandrel 22 loaded with tubular blind rivets and gripped by the gripping jaws, and the cursor 24 under pressure to urge the column of rivets forwardly along the mandrel, if the operator then presses the trigger 78, the intensifier is then signalled to deliver hydraulic fluid to the hydraulic chamber 62 causing the mandrel to be pulled rearwardly as previously explained and thereby drawing the mandrel head through the bore of a rivet supported by the abutment 20 and thus setting the rivet.

Provided the mandrel is gripped by the gripping jaws 26, then the forward movement of the column of rivets under the urging of the cursor 24 is limited by the leading rivet of the column abutting the enlarged head of the mandrel. It will, of course, be understood that the force applied through the cursor is not sufficient to force the leading rivet past the head of the mandrel: a much greater force, such as that applied by the hydraulic actuator to move the mandrel, is required to produce the necessary deformation of the rivet by the mandrel head.

However, if the mandrel is not held by the gripping jaws when the cursor is actuated, then the mandrel and rivets thereon could be inadvertently expelled from the tool.

In this embodiment of the invention, the dual air line 18 a flexible dual coaxial tube which is connected to a splitter junction 67 in the handle of the tool. In the splitter junction, the coaxial supplies are separated. One of the air supplies, intended for the rivet feeding means, is then taken directly via a conduit 69 to a manually operated feed control valve 68 formed in a valve module 70, and hence, through a conduit 72 and a port 74 in the ram, to enter the bore of the ram between the plug 40 and the jaw-closing piston 44. From there, the air supply is able to pass peripherally of the mandrel through the passageway 42 and into the barrel rearwardly of the cursor, and thus to urge the cursor forwardly in the barrel.

Figure 2:
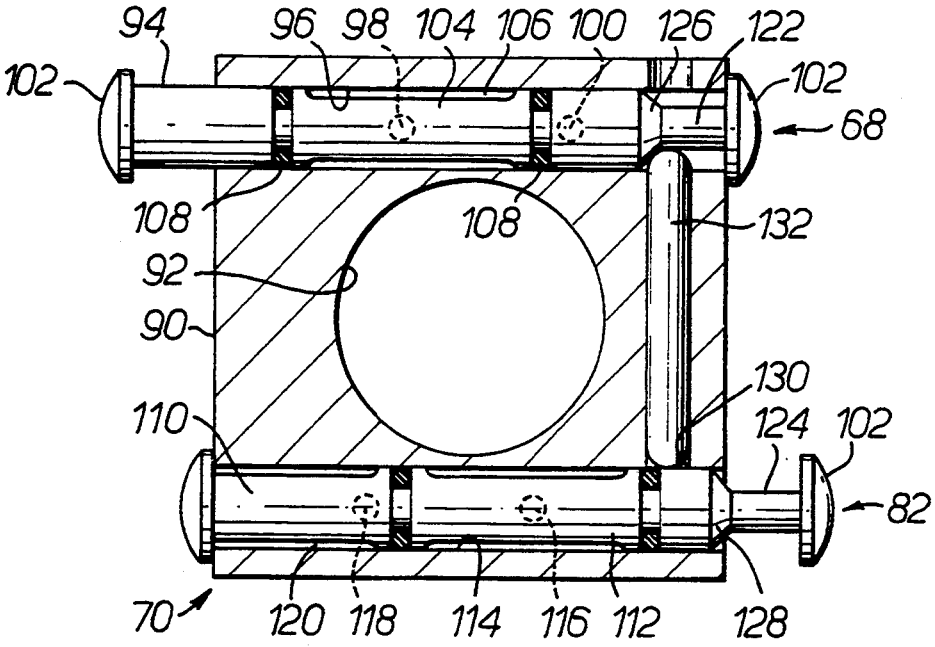
FIG. 2 is a sectional view of a valve module forming part of the apparatus of FIG. 1 and showing valves in their "OFF" condition.

The conduit 72 is helically coiled around the ram 48 so that, in concertina fashion, it is able to accommodate changes in length of the actuator due to movement of the ram relative to the cylinder member 64 and the valve module 70. The valve module 70, shown separately in FIG. 2, is a generally ring-shaped body, and is mounted in the housing 32, peripherally of the barrel 34, and just forward of the cylinder member 64.

The other of the separated air supplies is intended for the gripping means, and is taken by a conduit 76 from the splitter junction 67 to a manually operated trigger valve 78.

The trigger valve 78, when operated, serves to partially bleed air to atmosphere from the supply to the gripping means, causing a reduction of pressure in the supply line. This pressure reduction is recognized by the intensifier 12 as a signal to supply hydraulic fluid under pressure to the tool.

From the trigger valve 78, the air supply for the gripping means is then taken, via a non-return valve 80, to a manually operated gripper control valve 82 in the valve module 70. When the valve 82 is open, air is able to pass through a helically coiled conduit 84, similar to the conduit 72, to the jaw closing cylinder 46 which the air enters through a port 86 in a plug 88 which closes the rearward end of the jaw-closing cylinder 46 in the ram.

The non-return valve 80 serves to prevent loss of pressure in the conduit to the jaw-closing cylinder when the trigger valve is operated to bleed the line from the intensifier so that the grip of the jaws is not diminished.

The control valves 68 and 82, which respectively control the rivet feeding and mandrel gripping means, are formed as a unitary module in order that, while they can be operated separately, the rivet-feed controlling valve 68 can only be operated to actuate the rivet feed when the valve 82 is in a condition in which the mandrel gripping means is also actuated.

Referring, now, mainly to FIG. 2, of the drawings, the valve module 70 comprises a valve block 90 having a central aperture 92 through which the barrel of the tool extends, and the valves 68 and 82 are formed in the block on diametrically opposite sides of the aperture 92.

The two valves are generally similar, each comprising a through bore in which a spool valve member is slideable, together with inlet and outlet ports which communicate with the bore.

Thus, the feed control valve 68 comprises a spool member 94 slideable in a bore 96 which extends between two opposite faces of the block 90. The bore 96 has an inlet port 98, and an outlet port 100 spaced apart along its length and from the ends of the bore 96.

The spool member 94 is an elongate shaft, longer than the bore 96, and having radially enlarged retaining buttons 102, shaped for finger contact, at each end for retaining the member in the bore.

The shaft has a waist portion 104 of reduced diameter at a position intermediate between its ends which defines with the block an annular chamber 106 having an axial length slightly greater than the distance across the inlet and outlet ports 98, 100. The shaft has annular seals 108 to prevent the escape of air axially beyond the chamber 106.

Figure 3:
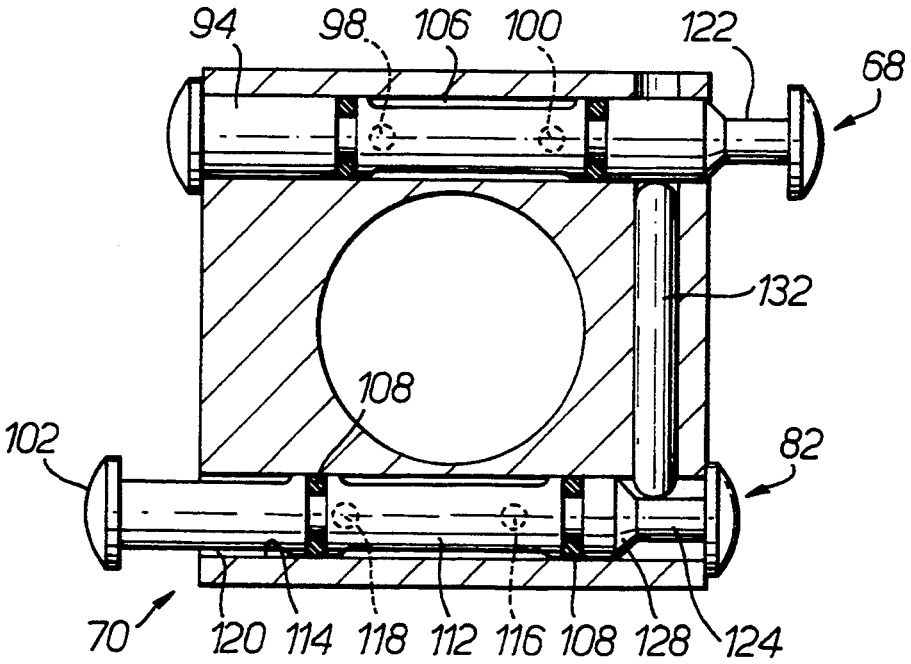
FIG. 3 is a view similar to FIG. 2 showing valves of the valve module in their "ON" condition.

The position of the waist portion 104 in relation to the ends of the shaft is such that, when the spool member 94 is at one end of its possible travel within the bore 96 (to the left as shown in FIG. 2), the inlet port 98 for the air supply is in register with the waist portion 104, but the outlet port 100 is out of register with the waist portion and is sealingly separated from the inlet port, whereas, when the spool member 94 is at the other end of its possible travel in the bore 96, (to the right as shown in FIG. 3) both the inlet port 98 and the outlet port 100 are in register with the waist 104, and air is therefore able to flow through the inlet port, into the annular chamber 106, and out through the outlet port 100, and thus to flow through the coiled conduit 72 to operate the rivet feed cursor 24.

The construction of the gripper control valve 82 is generally similar in principal to that of the valve 68, having a spool mender 110 formed with a waist 112 which is movable lengthwise of a bore 114 relative to an inlet port 116 and an outlet port 118 whereby, in one end of travel position of the member 110, (to the right, as shown in FIG. 2) the ports 116 and 118 are sealed from each other, and at the other end of its travel, (to the left, as shown in FIG. 3), the inlet and outlet ports 116, 118 are in communication so as to allow flow of air through to the jaw-closing cylinder 46.

However, it will be noted that the valve 82 differs from the valve 68 in two respects.

Thus, firstly, the relative positions of the ports 116, 118 and the waist portion 112 of the valve 82 are such that the ports are sealed from each other when the spool member 110 is to the right as shown in FIG. 2, whereas the ports of the valve 68 are sealed when the member 94 is oppositely located relative to the sides of the block 90, (that is, to the left as shown in FIG. 2). It will be noticed that in each of the valves, it is the air inlet port which remains in communication with the annular chamber when the spool member is moved, so that the air supply remains sealed against loss.

Secondly, the spool member 110 of the valve 82 only is formed with a bleedway 120, by reducing the diameter of the shaft adjacent to that end which is within the block 90 when the valve 82 is in the "OFF" condition, so as to permit air in the jaw-closing cylinder 46 to be vented to atmosphere when the valve 82 is switched to the "OFF" condition. This allows the gripping jaws 26 to release their grip on the mandrel.

In this embodiment of the invention, portions 122, 124 of those ends of the spool members 94 and 110 respectively which, as viewed in FIG. 2, are to the right, are reduced in diameter through tapering shoulders 126, 128 to form a narrow neck adjacent to the retaining button, and on the axis of the spool member.

A bore 130 intercepting the bores 96 and 114 houses a detent 132.

The detent is an elongate cylinder which is held captive in the bore 130 between the two spool members, and having rounded ends.

The detent 132 has a diameter such as to be a freely sliding fit in the bore 130, and has a length such that it is just able to fit between the neck portion of either one of the spool members and the full diameter part of the shaft of the other of the spool members.

In the "OFF" condition of the valves 68, 82, as shown in FIG. 2, the spool member 110 of the gripper control valve 82 is at the right hand end of its traverse so that its neck portion 124 projects beyond the right hand face of the block 90 as seen in FIG. 2, and the inlet and outlet ports are not in communication, and the spool member 94 of the feed control valve 68 is at the left hand end of its traverse so that its neck portion 122 is disposed within the block 90 and across the bore 130. Thus, the detent 132 is necessarily biased by the spool member 110 towards the neck portion of the spool member 94 and is so disposed in relation to the shoulder 126 as to positively prevent movement of the spool member 94 to the right hand end of its traverse so that the valve 68 is locked immovably in the "OFF" condition.

With the two spool members so disposed, no air is supplied to either the rivet feed means or the mandrel gripping means.

However, when the operator desires, it is possible for the operator manually first to move the spool member 110 of the gripper control valve to the left of its traverse, and thus to the "ON" condition as shown in FIG. 3, and then to move the spool member 94 of the feed control valve to the right of its traverse, and the "ON" condition as shown in FIG. 3.

It will be appreciated that, in moving the spool member 110 to the "ON" position, its neck portion is moved into alignment with the detent 132, so that the detent is then free to move towards the member 110, and so it then becomes possible by applying manual pressure to the spool member 94 and through the shoulder 126 to displace the detent towards the neck portion of the member 110, thus unlocking the member 94 and locking the member 110.

Thus it will be appreciated that the air supply must first be connected through the valve 82 to the jaw-closing cylinder 46, thus closing the gripping jaws 26 on the mandrel 22, and only then can the air supply be connected to actuate the rivet feeding means.

Similarly, when both valves 68 and 82 are in the "ON" position, it is then not possible to switch off the air supply to the gripping jaws until first the air supply to the rivet feeding means has been switched off. The feed control valve 68 must first be changed to its "OFF" condition, so that the neck portion 122 of its spool member 94 moves into alignment with the detent 132, thus freeing the detent to move towards the member 94. Only then is it possible, by applying manual pressure to spool member 110 and through the shoulder 128, to displace the detent 132 towards the neck portion of the member 94, so that the gripper control valve 68 can be changed to the "OFF" condition.

It is intended that the invention defined by the claims should not be limited to the details of the forgoing embodiment.

I claim:

1. Riveting apparatus comprising pneumatically operated mandrel-gripping means, pneumatically operated rivet-feeding means, and valve means for controlling the operation of the mandrel-gripping means and the rivet-feeding means, said valve means comprising a manually operable gripper-control valve for controlling the operation of the mandrel-gripping means, a manually operable feed-control valve for controlling the operation of the rivet feeding means, and means for interlocking both of said valves so that the rivet feeding means may be actuated to feed a rivet only when the mandrel-gripping means is also actuated to grip the mandrel.

2. Riveting apparatus as claimed in claim 1, wherein each of the valves comprises a valve member movable between a position in which air may flow through the valve and a position in which the flow of air is prevented, and the means for interlocking the valves comprises a detent which can be moved into locking engagement with each of the movable valve members alternately, and is held in such engagement by the other of the movable valve members.

3. Riveting apparatus as claimed in claim 2, wherein the valves are spool valves, each comprising a spool member movable longitudinally in a bore.

4. Riveting apparatus as claimed in claim 3, wherein the detent is movable in a bore which intercepts two valve bores.

5. Riveting apparatus as claimed in claim 2, wherein the detent is held in locking engagement with the movable valve member when said movable valve member prevents the flow of air to the feeding means.

6. Riveting apparatus as claimed in claim 2, wherein the detent is held in locking engagement with the movable valve member when said movable valve member permits the flow of air to the mandrel-gripping means.

7. Riveting apparatus as claimed in claim 2, wherein the detent is slidably fitted within a bore and has a length so as to fit between a neck portion of one of the movable valve members and a shaft portion of the other of the movable valve members.

8. Riveting apparatus as claimed in claim 2, wherein the detent is slidably fitted in a bore formed in the means for interlocking the valves.

9. Riveting apparatus as claimed in claim 1, which comprises a valve module, the valve module comprising a single block wherein each of the valves and the interlocking means are located in said single block.

10. Riveting apparatus as claimed in claim 9, wherein the module is incorporated in the riveting apparatus so that the mandrel passes through the module between the two valves.

11. Riveting apparatus comprising pneumatically operated mandrel-gripping means, and pneumatically operated rivet-feeding means, and having valve means for controlling the operation of both the mandrel-gripping means and the rivet-feeding means, said valve means comprising a manually operable feed-control valve for controlling the operation of the rivet-feeding means, and a manually operable gripper-control valve for controlling the operation of the mandrel-gripping means, the feed-control valve comprising a valve member movable between a valve-open position and a valve-closed position, and the gripper-control valve comprising a valve member moveable between a valve-open position and a valve-closed position, said apparatus including locking means comprising a movable locking member lockingly engageable alternately with the valve member of the feed-control valve and the valve member of the gripper-control valve, the arrangement being such that the valve member of the feed-control valve can be moved to the valve-open position only when the valve member of the gripper-control valve is in the valve open position, and the valve member of the gripper-control valve can be moved to the valve-closed position only when the valve member of the feed-control valve is in the valve-closed position.

12. Riveting apparatus comprising pneumatically operated mandrel-gripping means, and pneumatically operated rivet-feeding means, and having valve means for controlling the operation of both the mandrel-gripping means and the rivet-feeding means, said valve means comprising a manually operable feed-control valve for controlling the operation of the rivet-feeding means, and a manually operable gripper-control valve for controlling the operation of the mandrel-gripping means, the feed-control valve comprising a valve member movable between a valve-open position and a valve-closed position, and the gripper-control valve comprising a valve member movable between a valve-open position and a valve-closed position, said apparatus including locking means comprising a movable locking member lockingly engageable alternately with the valve member of the feed-control valve and the valve member of the gripper-control valve, the valve member of the feed-control valve being locked in the valve-closed position when the valve member of the gripper-control valve is in the valve-closed position, and the valve member of the gripper-control valve being locked in the valve-open position when the valve member of the feed-control valve is in the valve-open position.

13. Riveting apparatus comprising pneumatically operated mandrel-gripping means, and pneumatically operated rivet-feeding means, and having valve means for controlling the operation of both the mandrel-gripping means and the rivet-feeding means, said valve means comprising a manually operable feed-control valve for controlling the operation of the rivet-feeding means, and a manually operable gripper-control valve for controlling the operation of the mandrel-gripping means, the feed-control valve comprising a valve member movable between a valve-open position and a valve-closed position, and the gripper-control valve comprising a valve member movable between a valve-open position and a valve-closed position, said apparatus including locking means comprising a movable locking member lockingly engageable alternately with the valve member of the feed-control valve and the valve member of the gripper-control valve, the locking member being moved into, and held in, locking engagement with the valve member of the feed-control valve, when said feed-control valve member is in its valve-closed position, by movement of the valve member of the gripper-control valve to its valve-closed position, whereby the feed-control valve is locked in valve-closed condition when the gripper-control valve is in valve-closed condition, and the locking member being moved into, and held in, locking engagement with the valve member of the gripper-control valve, when the gripper-control valve is in valve-open condition, by movement of the valve member of the feed-control valve to its valve-open position, whereby the gripper-control valve is locked in valve-open condition when the feed-control valve is in valve-open condition.

14. Riveting apparatus comprising:

a pneumatically operated mandrel-gripping mechanism, a pneumatically operated rivet-feeding mechanism, and a valve mechanism for controlling the operation of the mandrel-gripping mechanism and the rivet-feeding mechanism, said valve mechanism comprising a manually operable gripper-control valve for controlling the operation of the mandrel-gripping mechanism, a manually operable feed-control valve for controlling the operation of the rivet feeding mechanism, and a mechanism for interlocking both of said valves so that the rivet feeding mechanism may be actuated to feed a rivet only when the mandrel-gripping mechanism is also actuated to grip the mandrel.

* * * * *